United States Patent [19]

Wise

[11] 3,977,046

[45] Aug. 31, 1976

[54] DENSITY SENSING AND CONTROLLING EQUIPMENT

[75] Inventor: Cecil S. Wise, Dallas, N.C.

[73] Assignee: Fiber Controls Corporation, Gastonia, N.C.

[22] Filed: May 31, 1974

[21] Appl. No.: 475,312

[52] U.S. Cl. ..... 19/240

[51] Int. Cl.[2] ..... D01H 5/38

[58] Field of Search ..... 19/239, 240, 241, ; 73/159, 160

[56] References Cited

UNITED STATES PATENTS

| | | | |
|---|---|---|---|
| 3,402,433 | 9/1968 | Schwalm | 19/240 X |
| 3,827,106 | 8/1974 | Varga | 19/240 |
| 3,852,848 | 12/1974 | Feller | 19/240 |

FOREIGN PATENTS OR APPLICATIONS

| | | | |
|---|---|---|---|
| 930,873 | 7/1963 | United Kingdom | 19/240 |
| 1,216,223 | 12/1970 | United Kingdom | 19/240 |

*Primary Examiner*—Dorsey Newton
*Attorney, Agent, or Firm*—Cushman, Darby & Cushman

[57] ABSTRACT

Apparatus in a card for sensing and controlling the relative speeds of the feed and doffer rolls in accordance with the sliver density. A mechanical sensing device responds to the cross-section of the sliver to close the contacts of an electrical circuit when the cross-section deviates from an acceptable range. On contact closure, the circuit provides an electrical signal to the drive arrangement of the feed and doffer rolls to vary the roll speeds thereby effecting a correction in sliver cross-section.

9 Claims, 4 Drawing Figures

DENSITY SENSING AND CONTROLLING EQUIPMENT

BACKGROUND OF THE INVENTION

This invention relates to the sensing of the density of rod-like material and to the controlling of the density thereof, and especially in the field of textile fibers this invention particularly relates to sensing the density of slivers produced by textile machines and to the controlling of the sliver density by controlling the input speed of the machine.

While the invention is particularly described below relative to a carding machine or card, it will be appreciated that the invention extends to other types of textile processing equipment, such as drawframes and pin drafters, which also produce slivers.

As above-indicated, besides relating to the sensing of sliver density, this invention also relates to the controlling of that density, i.e., to the automatic leveling of the density of the sliver produced by a textile machine or to rod-like material produced by other machines such as cigarette making machines. Automatic sliver leveling equipment for cards and other textile machines and machines in other fields are in general well known and are frequently referred to as "autolevelers." For example, the Zellweger Ltd. Company of Uster, Switzerland advertises a card sliver leveing device under the name "Uster's Control Card System," with an indication that sliver weight never exceeds ±2%. Used in such systems to measure the cross-section of the sliver is a pneumatic sensing trumpet or funnel-shaped nozzle such as shown in the Uster British Pat. No. 1,137,297 and also in U.S. Pat. No. 3,435,673 granted Apr. 1, 1969. Those patents review many of the prior art ways of sensing variation in the substance cross-section of textile material, slivers in particular, and of course describe in detail the Uster pneumatic way of measuring sliver cross-sections. Cross-sectional measurement by such prior art does in fact appear to measure sliver density effectively, or sliver weight if the thickness is held uniform. For reasons stated in those patents, the various measuring systems prior to the pneumatic measuring system have disadvantages and obviously so does the latter, which it is an object of the present invention to obviate.

SUMMARY OF THE INVENTION

The present invention measures the density of sliver by utilizing a tongue and groove type sensing roller arrangement having associated therewith a contact-carrying arm which is moved in response to variations in sliver cross-section to complete an electrical circuit which produces a corrective signal for the feed and doffer roll drive.

Use of tongue and groove rollers for sensing sliver cross-sections is known, and additionally, others have employed variable speed drives between the doffer and feed roll in cards, and have controlled therewith the input speed of the feed roll in response to the sensing of the sliver cross-section, thickness or density by the various ways discussed above. However, to applicant's knowledge, no one heretofore has employed the improved mechanical-electrical arrangement described below to sense and control the density of slivers. The details of the invention will become apparent from the following description, taken in conjunction with the accompanying drawings, of a preferred embodiment of the invention.

DETAILED DESCRIPTION OF THE DRAWINGS

Figure 1:
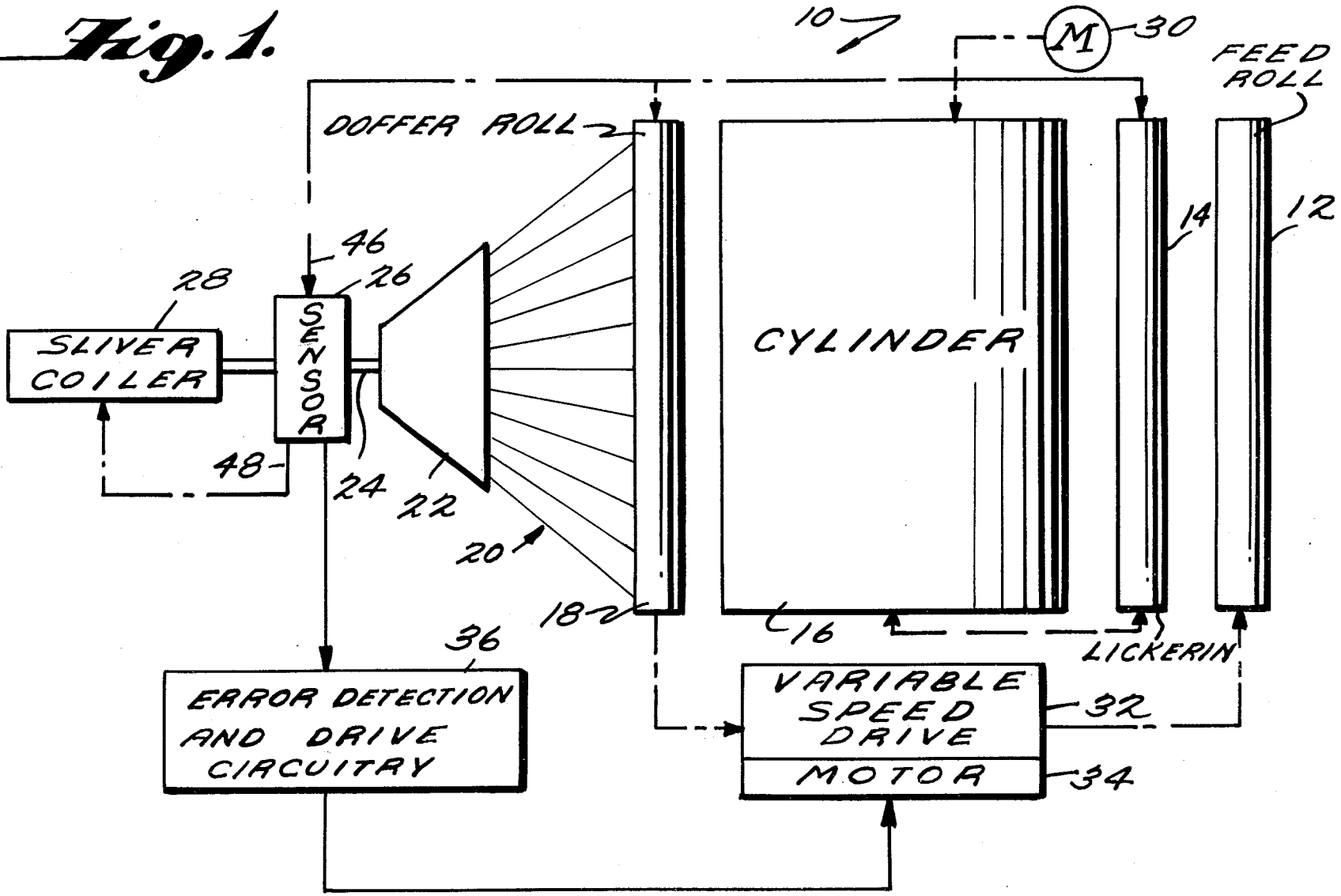
FIG. 1 is a diagrammatic top view of a card type of sliver producing textile machine including the invention hereof.

In FIG. 1 the textile fiber processing machine is diagrammatically indicated as a carding machine or card 10, which may be of any well known type in general, with the usual feed roll 12, lickerin 14, the large fiber paralleling cylinder 16, and a doffer roll 18. As is well known, roll 18 doffs cylinder 16 to remove therefrom a fine web of fibers. These fibers are brought together as a web 20 by a collecting device or trumpet 22 to produce therein sliver 24 which is pulled through the device 22 and a sensor 26, comprising cooperating tongue and groove type rollers, by conventional means such as calendar rolls (not shown). Thereafter, the sliver is coiled in the usual manner by coiler 28.

As is also conventional, an electric motor 30 drives the cylinder 16, lickerin 14, the doffer 18 and one of the rolls of sensor 26 in the usual manner, but the feed roll 12 is driven by the doffer roll through a variable speed drive 32 to which there is connected an electric motor 34. The variable speed drive 32 is preferably of the type which combines infinitely variable speed control with positive power transmission, e.g., the "PIV" type supplied by the Link-Belt Enclosed Drive Division of the FMC Corporation, such as shown in their book 3074 078(2), especially the electric remote control models thereof shown and described on pages 46 and 47 of that book. These latter variable speed drives therefore include motor 34 of FIG. 1.

As indicated above, the sliver 24 passes through sensor 26 which responds to the cross-section of the sliver to cause the operation of the error detection and drive circuitry 36, in a manner which hereinafter will be described in detail, when the cross-section deviates from an acceptable range. Operation of circuitry 36 produces an electrical signal which is connected to motor 34 to cause it to rotate in a forward or reverse direction and consequently to vary the speed of the variable speed drive 32 in a known manner. Varying the speed of drive 32 in turn causes the feed roll 12 to increase or decrease its speed relative to doffer roll 18 as well as the other components driven by motor 30. This results in a variation of the cross-section of the sliver to return it to its acceptable level.

Figure 2:
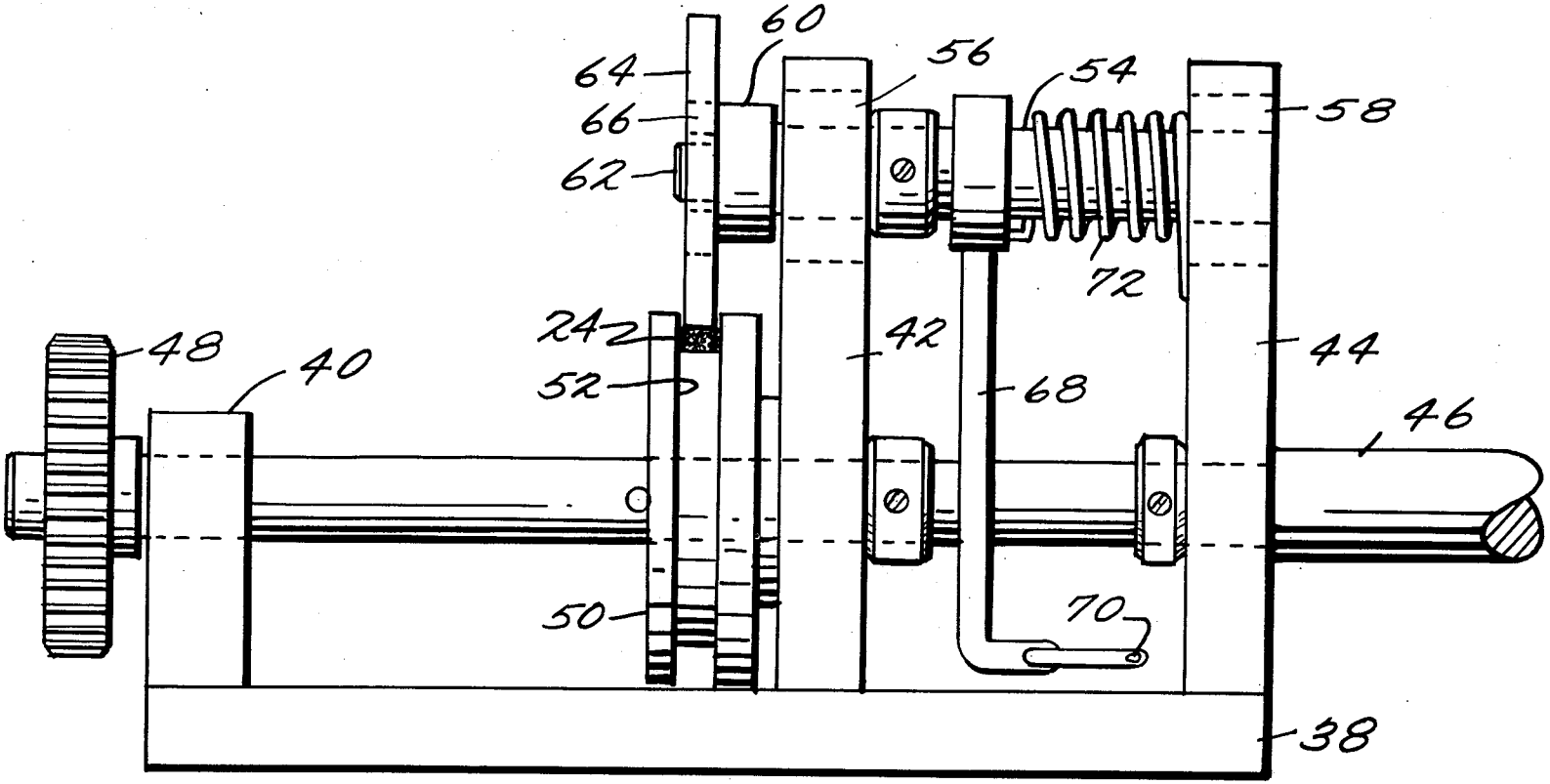
FIG. 2 is a front elevational view of the mechanical device employed in sensing sliver cross-section.
Figure 3:
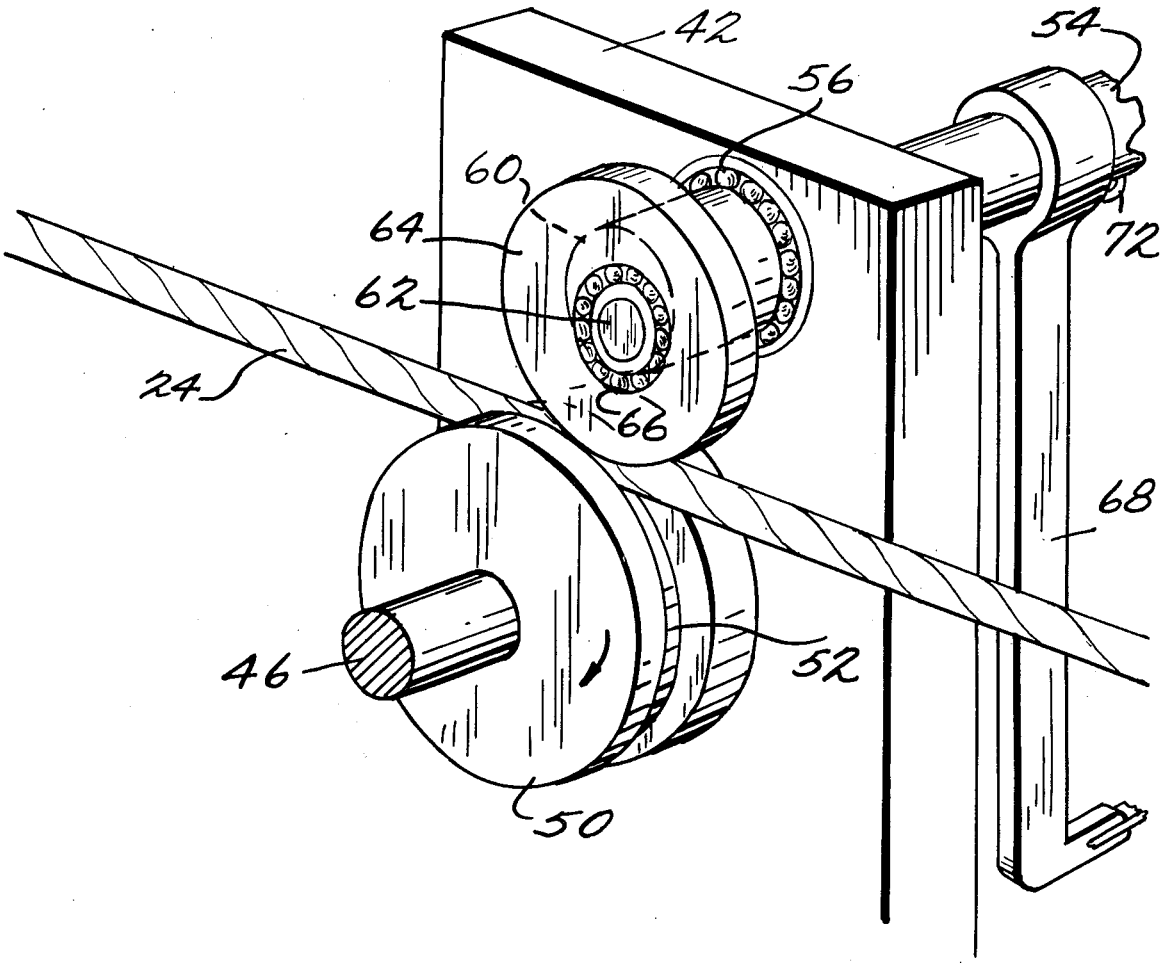
FIG. 3 is an enlarged perspective view of a portion of the device shown in FIG. 2.

The details of the sensor 26 can be appreciated by reference to FIGS. 2 and 3. The sensor includes a baseplate 38 to which bearing support plates 40, 42 and 44 are secured. A first shaft 46 is supported by bearings (not shown) within apertures through the support plates. Suitable gears 48 (only one of which is shown) are provided at opposite ends of shaft 46. These gears are used respectively to permit the shaft to be driven by motor 30 and to actuate sliver coiler 28. A roll 50 is secured to shaft 46 to rotate therewith. Roll 50 is provided with a groove 52 within which sliver 24 moves as it passes from collector 22 to coiler 28.

Support plates 42 and 44 also serve to support a second shaft 54 by means of suitable bearings such as roller bearings 56 and 58. The longitudinal axes of shafts 46 and 54 are parallel but are laterally offset with respect to one another. A portion of shaft 54 is of greater diameter than the remainder of the shaft thus forming a cylindrical plate 60 from which a cylindrical stub 62 projects. The longitudinal axis of stub 62 is offset laterally from the common longitudinal axis of shaft 54 and plate 60. A roll 64 is mounted on a bearing, such as roller bearing 66, for rotation about stub 62. Roll 64 is dimensioned to be received within groove 52 of roll 50. Thus, rolls 64 and 50 are in tongue and groove relationship, the sliver 24 passing therebetween. The bearing 66 permits free movement of roll 64 about the axis of stub 62.

An arm 68 is secured to shaft 54 between plates 42 and 44 for rotation with the shaft. Arm 68 carries at its free end an electrical contact, generally indicated as 70 in FIG. 2. The function of contact 70 will be described hereinafter in connection with FIG. 4. A torsion spring 72 is positioned about shaft 54 between plate 44 and arm 68 so as to maintain roll 64 firmly in contact with sliver 24 as it passes between rolls 50 and 64.

The relationships of the longitudinal axes of shaft 46 and stub 62 are such that variations in the cross-section of sliver 24 causes the raising or lowering of roll 64. This in turn, because of the off-set axes of stub 62 and plate 60, is translated into rotational movement of shaft 54. Consequently, arm 68 is moved resulting in the displacement of the contact 70 at the end of the arm. The degree of movement of arm 68 in response to sliver cross-section variations is, of course, a function of the dimensions and axial relationships of the various components of the sensing device.

Figure 4:
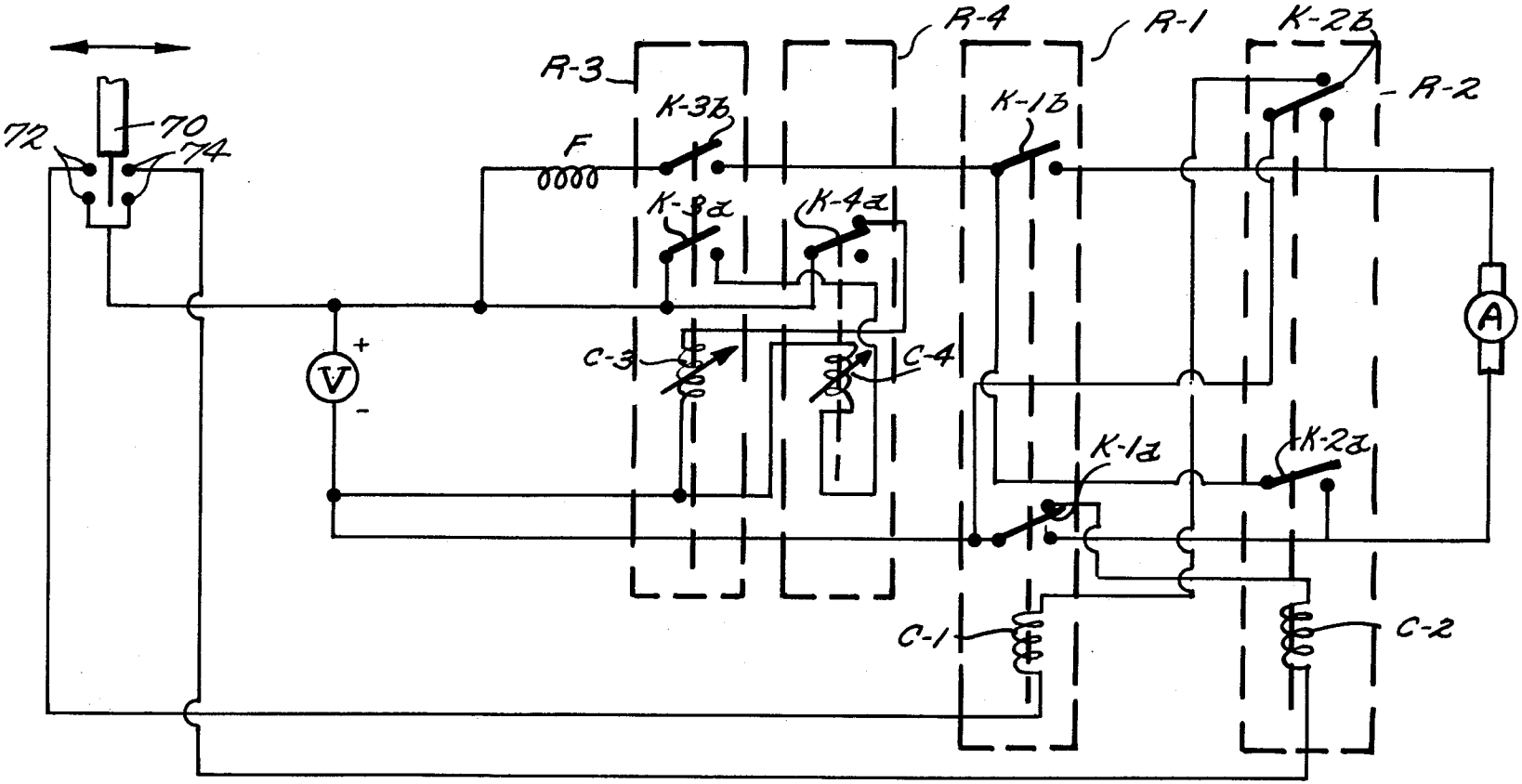
FIG. 4 is a schematic diagram of electrical circuitry for deriving a signal representing deviation of the sliver density.

The manner by which contact 70 functions to correct undesired deviations of sliver 24 from the norm will be described with respect to FIG. 4. A d.c. voltage source V is provided to selectively energize the armature A of motor 34 shown in FIG. 1. Control of current flow to armature A is established by relays R-1 and R-2. Relay R-1 includes a coil C-1 and contacts K-1*a* and K-1*b*, while Relay R-2 comprises coil C-2 and contacts K-2*a* and K-2*b*. The relay contacts are shown in the unenergized state of their respective coils. The motor field winding F is connected to source V and to a relay contact K-3*b* which serves as a master on-off timer switch as will be described hereinafter.

The movable contact 70 is associated with two pair of contacts. The first pair 72 connects source V to relay coil C-1 when contact 70 is moved sufficiently to the left from the position shown to engage contacts 72. If contact 70 is moved to the right to engage the second contact pair 74, a path is completed from source V to relay coil C-2.

Assuming that relay contact K-3*b* is closed, no current path exists between source V and armature A since neither relay coil C-1 nor C-2 is energized. However, on sufficient displacement of contact 70 to the left, in response to a deviation of the sliver 24 from an acceptable range, a circuit is completed from one side of V, through contacts 70 and 72, and through coil C-1 and contact K-2*b* to the other side of V. As a result of the energization of C-1, contacts K-1*a* and K-1*b* are moved to complete a circuit from said one side of source V through winding F, contacts K-3*b* and K-1b, armature A and contact K-1*a* to the other side of V. This results in the armature A being rotated in one direction to vary the speed of drive 32 thereby performing a correction function.

If on the other hand, the deviation of sliver 24 causes contact 70 to move to the right to engage contacts 74, a circuit is completed from the said one side of the source V, through contacts 70 and 74, and through coil C-2 and contact K-1*a* to the said other side of V. The resultant energization of C-2 moves contacts K-2*a* and K-2*b* to complete a circuit from said one side of V through winding F, contacts K-3*b*, and K-2*a*, armature A and contact K-2*b* to the other side of V. It will be appreciated that current flow through the armature A in this case is in a direction opposite to that when contact 70 engaged contacts 72. Thus, the armature is rotated in the opposite direction to vary drive 32 and thereby effect the necessary correction.

In the foregoing examples it has been assumed that contact K-3b was continuously closed. However, if in practice such were the case, it is possible that the corrective action of drive 32 might cause an overshoot and thus result in the system's "hunting". This would cause the long term density of the sliver to continuously increase and decrease rather than staying level. To overcome this problem, the operation of contact K-3*b* is controlled so that it acts as a timed on-off switch. This is accomplished by the use of a pair of time delay relays R-3 and R-4. Relay R-3 includes a coil C-3 and contacts K-3*a* and K-3*b*, while relay R-4 comprises coil C-4 and contact K-4*a*. Again, the relay contacts are shown as they exist when their respective coils are not energized.

As illustrated, a current path exists from one side of source V through contact K-4*a*and coil C-3 to the other side of V. Consequently, contacts K-3*a* and K-3*b* close, the latter permitting the sliver correction circuit to assume that "on" condition. Closure of K-3*a* completes a circuit from one side of source V through K-3*a* and coil C-4 to the other side of V. As a result, contact K-4*a* opens to interrupt the energization of coil C-3. However, due to the delay characteristics of relay R-3, contacts K-3*a* and K-3*b* do not open for a predetermined time. When they do, the correction circuit is turned "off" and the energization of coil C-4 is interrupted. Due to the delay characteristics of R-4, contact K-4*a* does not return to the position illustrated for a predetermined time, but upon such return the described cycle is repeated.

The foregoing operation permits contact K-3*b* to be closed and opened for periods determined by the settings of delay relays R-3 and R-4. Thus, the operation of K-3*b* is timed in cyclic fashion so that corrections by drive 32 can be made in increments. Such a procedure prevents over-correction of the sliver density and mades it possible to return the density to the desired level. This level may be set by various means such as adjustment of the relative positions of contacts 70, 72 and 74. Representative on and off times as presently preferred are 0.3 seconds on and 72 seconds off for cards operating not only at the normal 60 lbs. per hour but also when operated at 35 or 80 lbs. per hour. The 22 second off interval is the approximate long term correction time, i.e., the time for a speed correction made at the feed roll 12 to be sensed by sensor 26, when operating around 50 or 60 lbs. per hour. On the other hand, the 0.3 second on time has been successfully used by rotating about one revolution (out of 8.2 possible revolutions) the speed adjusting control screw of Model 05 motorized positive variable speed power transmission 32, 34 supplied by Fairchild Industrial Products Division of Winston Salem, N.C., as described in their Catalog 207C, dated 4-72, having a speed range of 5:1.

This invention is applicable not only to cards which initially have tongue and groove output rolls, but also to cards which have calendar rolls to draw the sliver from the collector or trumpet 22. That is, such calendar rolls can be removed and the tongue and groove arrangement according to this invention can be inserted. Further, while the right hand end of FIG. 2 has shaft 46 being driven and the left hand end has gear 48 that is coupled to drive coiler 28, the opposite arrangement may be effected to accomodate a coiler that needs to set on the opposite side of the sensor. That is, both ends of shaft 46 may be made stubs as shown at the left end of FIG. 2, so that either may accomodate gear 48 and the other can be coupled to the motorized drive linkages from lickerin 14 and doffer roll 18. In this way the tongue and groove arrangement of FIG. 2 can readily be installed for either a right or left coiler location.

What is claimed is:

1. A textile processing machine having a sliver density sensing and control apparatus comprising:

speed variable feeding means for receiving and feeding fibers to be processed by said machine, means for producing sliver including doffing means operable at a given speed and spaced from said feeding means, and means between said feeding and doffing means for processingly operating on fibers received from said feeding means within a predetermined processing time between the time fibers are fed by said feeding means and doffed by said doffing means, variable speed driving means between said doffing and feeding means for controlling the speed of the fiber feeding means relative to the speed of said doffing means, means connected to said machine and operative on said produced sliver for sensing variations in the effective relative density thereof for producing an electrical signal related to said variations from a predetermined norm, and circuitry operatively related to said driving means, said circuitry including: a voltage source, a timer-controlled switch, timer means operative independently to said electrical signal for cyclically moving said timer-controlled switch between open and closed positions, and additional switching means responsive to the sense of said electrical signal for completing a circuit from the voltage source through the timer-controlled switch, when said switch is in its closed position, to said driving means thereby actuating the driving means to return and sliver density back towards the predetermined norm.

2. A textile processing machine as in claim 1, wherein said timer means includes means for closing said timer-controlled switch for a relatively small increment of time compared to said processing time to cause an incremental speed change in said feeding means to reduce said variations towards the norm and for opening said timer-controlled switch for a time interval which is within a range of approximately one-half to one and a half times the predetermined processing time.

3. A textile processing machine as in claim 2, wherein said textile processing machine is a card and wherein said timer-controlled switch is closed for approximately 0.3 second and open approximately 22 seconds.

4. A textile processing machine as in claim 1, wherein sliver density is a function of sliver cross-section and wherein asid sensing means includes:

a cooperating tongue and groove arrangement, said tongue extending within the groove such that the sliver is positioned between and in contact with said tongue and groove;

means providing relative movement between the tongue and groove in response to variations in sliver cross-section as the sliver moves therebetween; and means responsive to changes in relative positions of said tongue and groove resulting from variations in sliver cross-section from said predetermined norm to complete an electrical circuit thereby producing said electrical signal.

5. A textile processing machine as in claim 4 wherein said timer means includes means for closing said timer-controlled switch for a relatively small increment of time compared to said processing time to cause an incremental speed change in said feeding means to reduce said variations towards the norm and for opening said timer-controlled switch for a time interval which is within a range of approximately one-half to one and a half times the predetermined processing time.

6. A textile processing machine as in claim 5, wherein said textile processing machine is a card and wherein said timer-controlled switch is closed for approximately 0.3 second and open approximately 22 seconds.

7. A textile processing machine having a sliver density sensing apparatus comprising:

means for producing a multiplicity of fibers;

means for collecting said fibers and producing a sliver;

a first roller having a groove therein for receiving said sliver;

a second roller having a projecting portion extending within said groove whereby the sliver is positioned between, and in contact with, said projecting portion and the first roller;

movable support means for supporting one of said rollers for rotation about a first axis;

a shaft secured to said support means and responsive to movement thereof to rotate about a second axis parallel to, and laterally offset with respect to, said first axis whereby variations in cross-section of sliver positioned between said rollers are translated by the said one roller and the movable support means into rotation of said shaft about the second axis;

electrical contact means secured to said shaft for movement therewith; and circuitry responsive to the movement of said contact means for producing an electrical signal representative of the deviation of sliver density from a norm which is based on the sliver cross-section, said circuitry including: a voltage source, a timer-controlled switch, timer means operative independently of said electrical signal for cyclically moving said timer-controlled switch between open and closed positions, and additional switching means responsive to said electrical signal for completing a circuit from the voltage source through the timer-controlled switch, when said switch is in its closed position, to means for varying the operation of the fiber producing means thereby causing the sliver to return towards said norm.

8. A textile processing machine as in claim 7, wherein said timer means includes means for closing said timer-controlled switch to pass the electrical signal to the varying means for a relatively small increment of time compared to the machine processing time and for opening said timer-controlled switch for a time interval which is within a range of approximately one-half to one and a half times the predetermined processing time.

9. A textile processing machine as in claim 8 wherein said processing machine is a card and said relatively small increment of time is approximately 0.3 second and the time interval when said timer-controlled switch is open is approximately 22 seconds.

* * * * *